US006141957A

United States Patent [19]

Tsukagoshi et al.

[11] Patent Number: 6,141,957

[45] Date of Patent: Nov. 7, 2000

[54] FLAME DETECTOR FOR COMBUSTOR

[75] Inventors: Keizo Tsukagoshi, Tokyo; Satoshi Tanimura; Katsuhiko Abe, both of Takasago, all of Japan

[73] Assignee: Mitsubishi Heavy Industries, Ltd., Tokyo, Japan

[21] Appl. No.: 09/214,928

[22] PCT Filed: May 13, 1998

[86] PCT No.: PCT/JP98/02114

§ 371 Date: Sep. 17, 1999

§ 102(e) Date: Sep. 17, 1999

[87] PCT Pub. No.: WO98/53254

PCT Pub. Date: Nov. 26, 1998

[30] Foreign Application Priority Data

May 20, 1997 [JP] Japan ..... 9-129663

[51] Int. Cl.[7] ..... F02G 1/00

[52] U.S. Cl. ..... 60/39.33; 431/13; 356/315

[58] Field of Search ..... 60/39.33; 431/13; 356/315, 417

[56] References Cited

U.S. PATENT DOCUMENTS

| | | | |
|---|---|---|---|
| 4,981,088 | 1/1991 | Burris | 110/193 |
| 5,578,828 | 11/1996 | Brown et al. | 250/342 |
| 5,829,962 | 11/1998 | Drasek et al. | 431/79 |

FOREIGN PATENT DOCUMENTS

| | | | |
|---|---|---|---|
| 53-47407 | 4/1978 | Japan . | |
| 1159423 | 6/1989 | Japan | 60/39.091 |
| 5195818 | 8/1993 | Japan . | |
| 693882 | 4/1994 | Japan . | |
| 9-133023 | 5/1997 | Japan . | |
| WO 8101441 | 5/1981 | WIPO | 60/39.33 |

*Primary Examiner*—Charles G. Freay

*Attorney, Agent, or Firm*—Wenderoth, Lind & Ponack, L.L.P.

[57] ABSTRACT

In a starter combustor of a pressurized fluidized bed combined cycle power system, disorder of a flame detecting device due to ash accumulation is prevented. A fuel nozzle (33) of the starter combustor is provided so as to be directed to an inner cylinder (32) and a pipe (38) of a fitting pipe (36), which is connected to the inner cylinder (32). A valve body (1), having a valve body passage **(1*a*), is provided so as to be connected to one end of the fitting pipe (36) and a valve component (3). The valve component (3) has a recess portion 3*a* and is connected to a shaft (1*a*) . When the combustor is started, the shaft (2), which is engaged rotatably with shaft fitting portion (3*a*') of the valve component (3) and is in threaded engagement with a threaded portion of the valve body (1), is moved by handle (4) so that the valve component is moved and the passage (1*a*) is opened. While the combustor is stopped, the passage (1*a*) is closed by the valve component (3). In ordinary operation time, ash is collected in the recess portion (3*a*) of the valve component (3), and therefore ash does not accumulate on a glass plate (37)** and disorder of the flame detecting device due to ash accumulation does not occur.

8 Claims, 8 Drawing Sheets

FLAME DETECTOR FOR COMBUSTOR

This application is a filing under 35 U.S.C. § 371 of International Application No. PCT/JP98/02114.

BACKGROUND OF THE INVENTION

1. Field of the Invention

The present invention relates generally to a flame detecting device of a gas turbine starter combustor in a pressurized fluidized bed combined cycle power system, and specifically to that having a structure which is able to prevent dirt due to combustion gas ash from sticking.

2. Description of the Prior Art

FIG. 4 is a schematic view of a prior art pressurized fluidized bed combined cycle power system. In FIG. 6, fuel of coal or the like is burned at a pressurized fluidized bed boiler 13 so that steam system pipings thereof are heated to generate steam for driving of a steam turbine (not shown) as well as a high temperature combustion gas thereof, of about 800° C. for example, is supplied into a gas turbine 11 via a duct 18 and its exhaust gas is discharged outside.

Air from a compressor 12, which is driven by the gas turbine 11, is supplied into the pressurized fluidized bed boiler 13 as a combustion air via a compressor outlet valve 14. On the other hand, at a plant start where the pressurized fluidized bed boiler 13 is not in a sufficient operation yet, because the high temperature combustion gas is not supplied into the gas turbine 11 sufficiently yet via the duct 18, the compressor outlet valve 14 is switched so that the air from the compressor 12 is taken into a starter combustor 30 as the combustion air via a duct 19, thus the gas turbine 11 is started by the starter combustor 30.

When the pressurized fluidized bed boiler 13 is heated, the compressor outlet valve 14 is switched so that the air from the compressor 12 is stopped to flow into the starter combustor 30 and the gas turbine 11 is started by the high temperature combustion gas from the pressurized fluidized bed boiler 13 to come in an ordinary operation.

FIG. 7 is a detailed cross sectional view of the starter combustor 30 mentioned above. In FIG. 7, the high temperature combustion gas from the pressurized fluidized bed boiler 13 enters portion A and gas generated by combustion therein is supplied into the gas turbine 11 via portion B. Numeral 31 designates a pipe fitted to the combustor main unit. The pipe 31 comprises an inner cylinder 32 and there is disposed a fuel nozzle 33 close to one end of the inner cylinder 32. Light oil is supplied to the fuel nozzle 33 to be injected into the inner cylinder 32 for combustion in the combustor main unit.

A fitting pipe 36, having a flame detector 34 fixed to its one end, is inserted into the inner cylinder 32 from outside so as to connect to an interior of the inner cylinder 32 for detection of flames. Numeral 39 designates a combustion air inlet and the air flowing through the compressor outlet valve 14 is led into the combustor main unit for combustion via portion C.

FIG. 8 is a detailed cross sectional view of a flame detecting device including the flame detector 34 mentioned above. An adapter 35, having therein a through hole, has its one end fitted to the fitting pipe 36 and the flame detector 34 is fitted to the other end of the adapter 35. The fitting pipe 36 is fixed to the combustor main body and a pipe 38 is inserted in the fitting pipe 36 so as to connect at one end of the pipe 38 to the inner cylinder 32 and at the other end to the through hole of the adapter 35 and to the flame detector 34. Numeral 37 designates a glass plate provided on an end portion of the flame detector 34.

In the flame detector 34 fitted as mentioned above, there is incorporated a photoelectric element and state of flames is detected through an end portion 38*a* of the pipe 38 opening to the inner cylinder 32 such that ultraviolet rays generated by the flames are led to the photoelectric element and state of the flames is detected by the strength thereof.

In the pressurized fluidized bed combined cycle power system as described above, there is provided the starter combustor 30, which is operated at a plant start for starting the gas turbine 11. When the temperature of the pressurized fluidized bed boiler 13 rises, operation of the starter combustor 30 is stopped so that the gas turbine 11 is then driven by the high temperature gas from the boiler 13 for ordinary operation. In the gas turbine 11 of such pressurized fluidized bed combined cycle power system, fuel such as coal or the like is burned by the pressurized fluidized bed boiler 13 and the high temperature gas so generated is used as an operating fluid, hence, while the plant is in ordinary operation or while the pressurized fluidized bed boiler 13 is being cooled after the plant is stopped, coal ash contained in the operating fluid enters the flame detector 34 through the end portion 38*a* which is open to the inner cylinder 32 and sticks to a surface of the glass plate 37 resulting in a loss of the flame detector 34 function.

SUMMARY OF THE INVENTION

In view of such problem in the prior art flame detecting device, it is an object of the present invention to provide a flame detecting device for detecting a flame state in a starter combustor etc. exposed to a high temperature combustion gas containing coal ash as an operating fluid of a gas turbine, in which even if coal ash etc. sticks to a glass plate of an inlet portion of the flame detector, it can be removed and the flame detector functions well without the influence of ash sticking.

In order to achieve said object, the present invention provides the following means:

(1) A combustor flame detecting device for use in a gas turbine starter combustor in a pressurized fluidized bed combined cycle power system in which a gas turbine is driven by a combustion gas from a pressurized fluidized bed boiler, characterized in comprising a flame detector connected to a passage connecting to an interior of the starter combustor. A valve component is provided in the passage at an inlet portion of the flame detector. The valve component has a recess portion for receiving ash coming into the flame detector from the interior of the starter combustor. Also, a drive means or drive device is provided for driving the valve component in order to open and close the passage.

(2) A combustor flame detecting device for use in a gas turbine starter combustor in a pressurized fluidized bed combined cycle power system in which a gas turbine is driven by a combustion gas from a pressurized fluidized bed boiler. The device includes a flame detector connected to a passage connecting to an interior of the starter combustor. A valve component is provided in the passage at an inlet portion of the flame detector and has a recess portion for receiving ash coming into the flame detector from the interior of the starter combustor. A drive means is provided for driving the valve component so as to open and close the passage. Also, an air nozzle system is provided to pass through into the passage from outside of the passage so as to blow pressurized cleaning air to the vicinity of the recess portion of the valve component.

(3) A combustor flame detecting device as mentioned in (1) or (2) above, characterized in that the drive means comprises a shaft which is connected rotatably to the valve component and is movable in a direction orthogonal to the passage by being rotated in a threaded engagement with a threaded portion provided in a valve body. Also, a manual handle is connected to the shaft.

(4) A combustor flame detecting device as mentioned in (1) or (2) above, characterized in that the drive means comprises a shaft which is connected rotatably to the valve component and is movable in a direction orthogonal to the passage by being rotated in a threaded engagement with a threaded portion provided in a valve body. A motor is connected to the shaft, and a control means or controller is provided for controlling the motor. The control means is associated with a burner igniting signal of the starter combustor to rotate the shaft for movement of the valve component.

(5) A combustor flame detecting device as mentioned in (1) or (2) above, characterized in that the drive means comprises a shaft which is slidably connected to the valve component and is movable in a direction orthogonal to the passage. An actuator is connected to the shaft, and control means or controller is provided for controlling the actuator. The control means is associated with a burner igniting signal of the starter combustor for movement of the valve component.

In the invention of (1) above, there is provided the valve component, having the recess portion, in the passage at the inlet portion of the flame detector and when the starter combustor is in operation, the passage is opened by the valve component so that the flames in the combustor may be detected. While the starter combustor is stopped, the passage is closed by the valve component and coal ash, coming into the passage from the interior of the starter combustor in the ordinary operation time of the pressurized fluidized bed combined cycle power system, is received to be collected in the recess portion of the valve component. While the passage is open, the valve component is drawn out of the passage.

In the invention of (2) above, in addition to the construction of (1) above, there is provided the air nozzle system and when the passage is to be opened by the valve component, immediately before that, the coal ash collected in the recess portion of the valve component is blown off by the air injected from the air nozzle system and then the valve component is drawn out of the passage.

In the invention of (3) above, the drive means is constructed by the rotatable and movable shaft and the manual handle, hence the handle is rotated manually to rotate the shaft and to move the valve component and the passage can be opened and closed.

In the invention of (4) above, the drive means is constructed by the same shaft as in (3) above, the motor and the control means of the motor and when the burner of the starter combustor is ignited, the control means receives a signal thereof and drives the motor to rotate the shaft and to move the valve component to open the passage, hence the passage can be opened automatically at the same time as the starter combustor starts and detection of the flames becomes possible. Needless to mention, when the burner of the starter combustor is stopped, the control means rotates the motor reversely so that the passage is closed by the valve component.

Further, in the invention of (5) above, in place of the above motor, there is provided the actuator which is driven linearly, hence the same function as in (4) above can be effected by the linear movement of the actuator.

According to the flame detecting device of the present invention as described above, there is no fear of disorder of the flame detector due to the ash coming to the inlet portion of the flame detector of the starter combustor in the pressurized fluidized bed combined cycle power system to be accumulated on the glass plate and the starting of the gas turbine can be perfomed safely.

DESCRIPTION OF THE PREFERRED EMBODIMENTS

Figure 1:
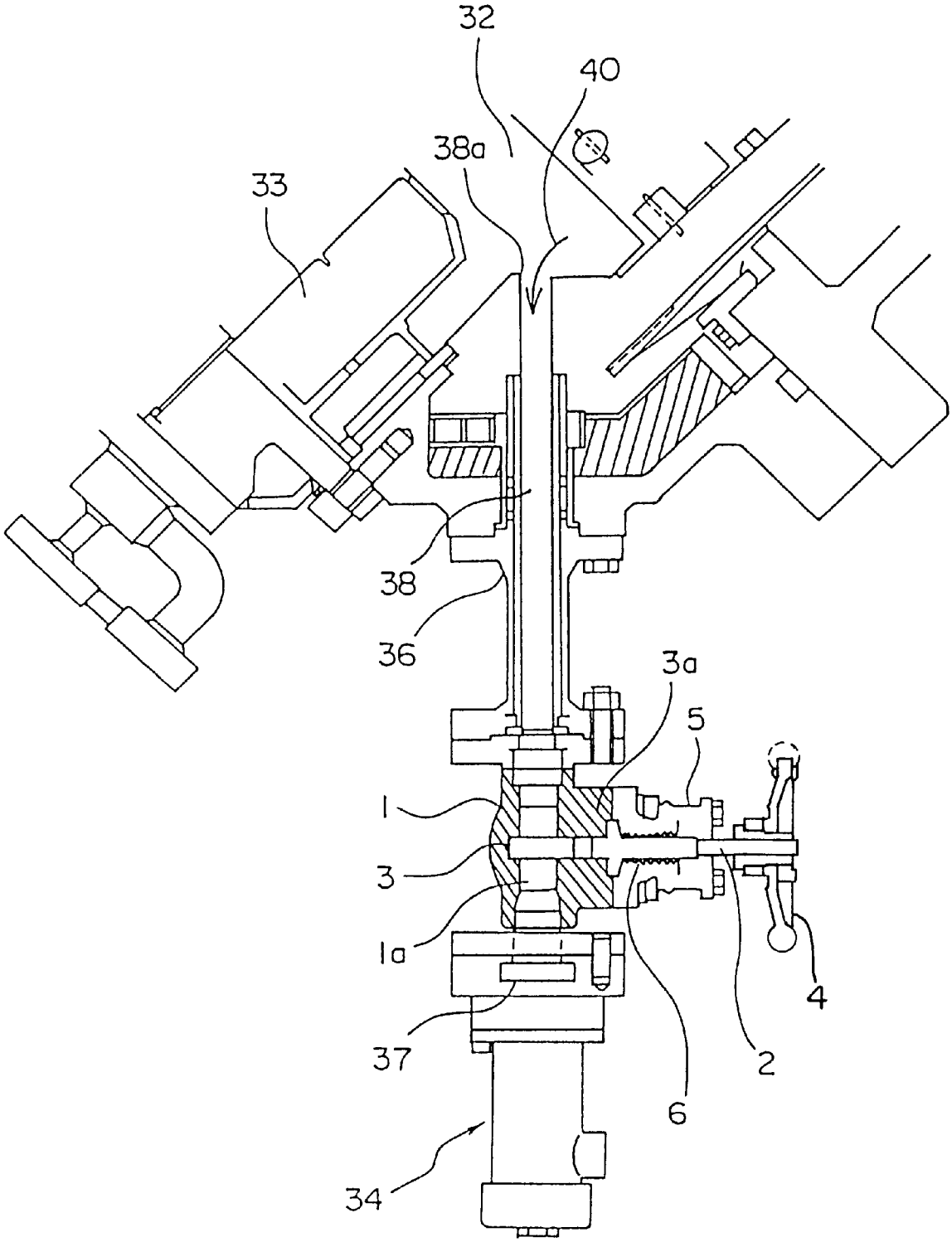
FIG. 1 is a cross sectional view of a flame detecting device for a combustor of one embodiment according to the present invention.

Herebelow, description will be made regarding embodiments according to the present invention with reference to the figures. FIG. 1 is a cross sectional view of a flame detecting device of a combustor of one embodiment according to the present invention. In FIG. 1, numerals 32 to 34 and 36 to 38 designate parts or components having same functions as those shown in FIG. 7 with respect to the prior art device and description thereof will be omitted. Featured portions of the present invention, being portions shown by reference numerals 1 to 6, will be described below in detail.

Figure 7:
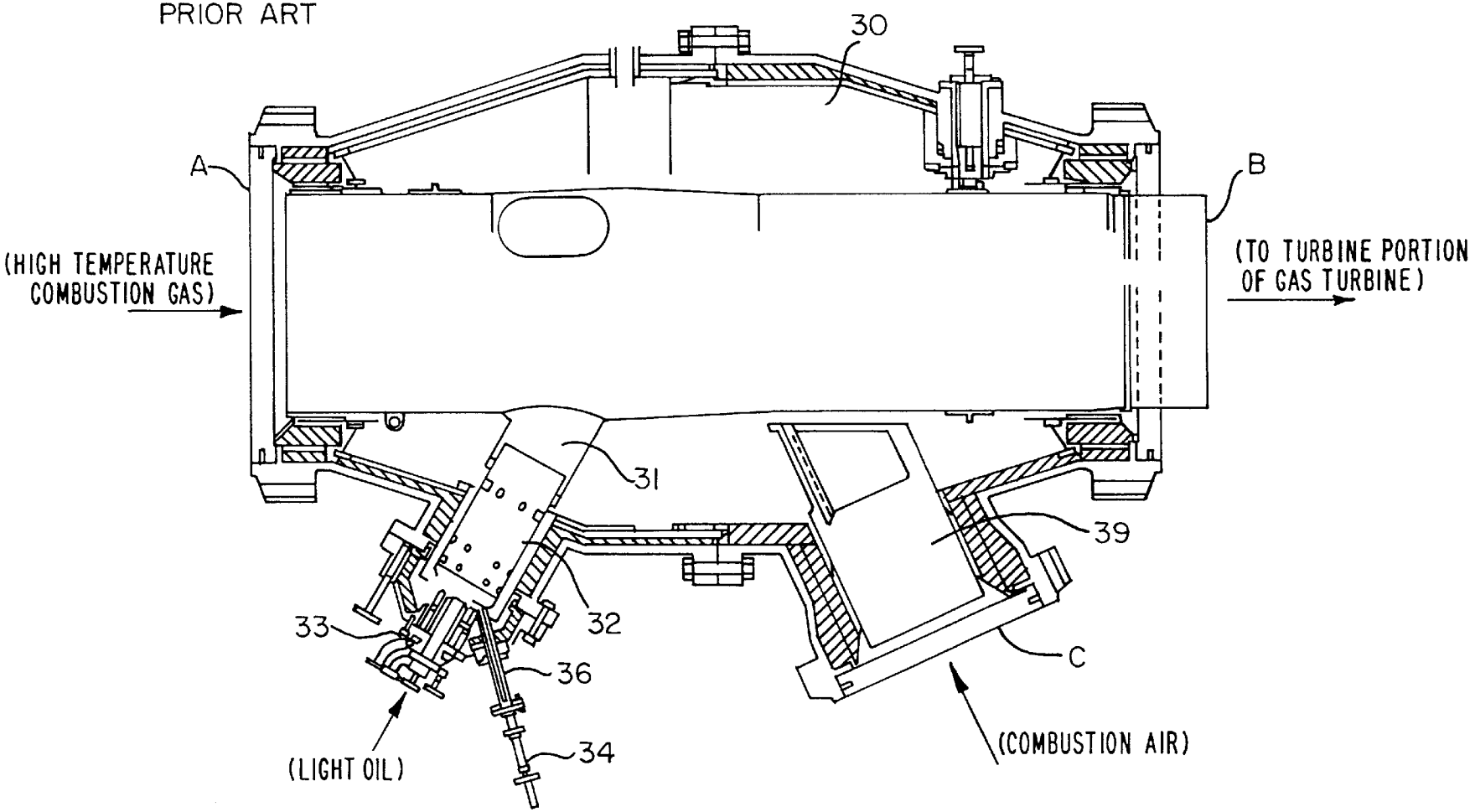
FIG. 7 PRIOR ART
FIG. 7 is a detailed cross sectional view of a starter combustor in the prior art pressurized fluidized bed combined cycle power system.
Figure 8:
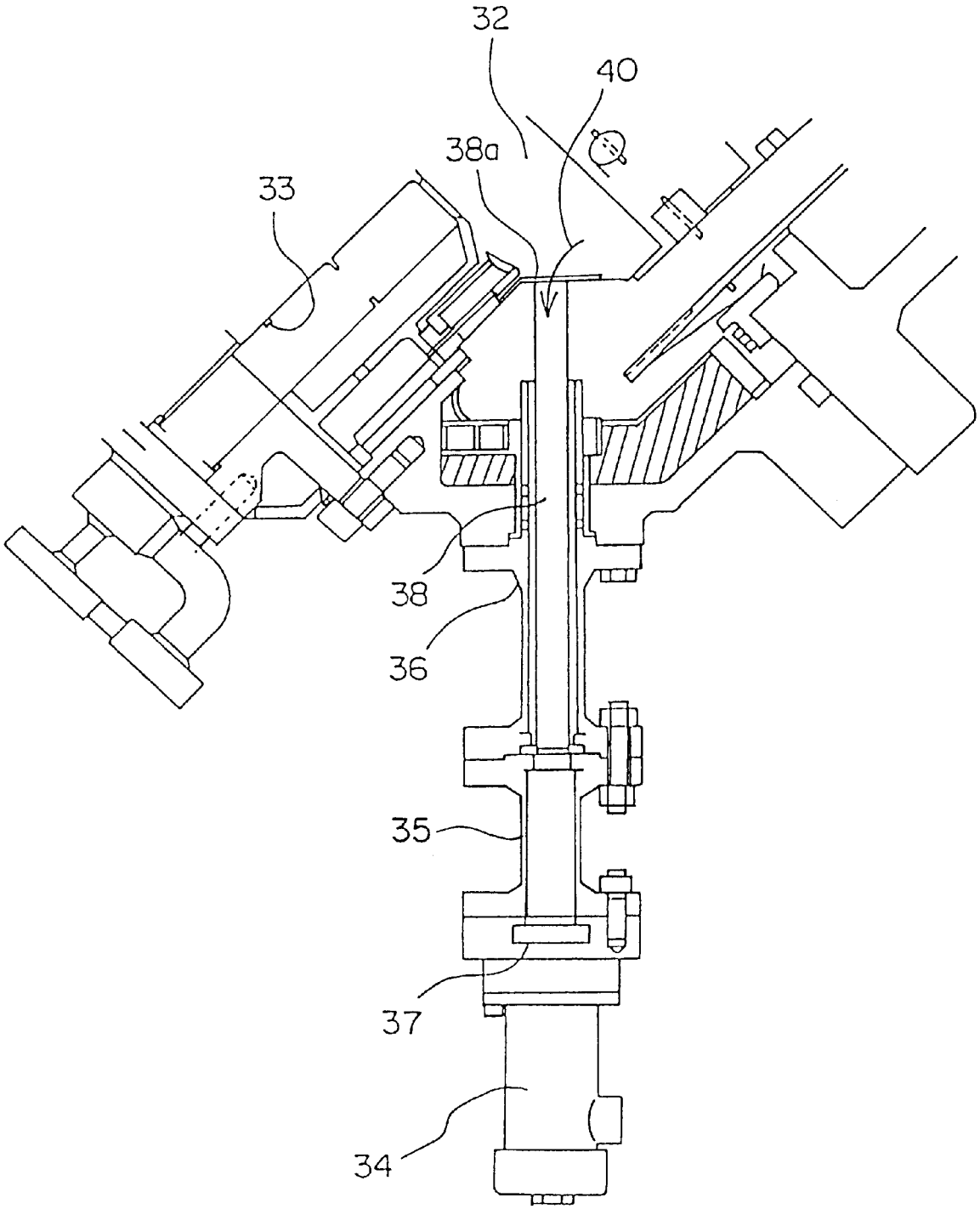
FIG. 8 PRIOR ART
FIG. 8 is a detailed cross sectional view of a prior art flame detecting device used in the starter combustor of the pressurized fluidized bed combined cycle power system.

Like the prior art device, the flame detecting device of FIG. 1 is applicable to the starter combustor 30 in the pressurized fluidized bed combined cycle power system as described in FIG. 7. Numeral 1 designates a valve body, which is provided between the fitting pipe 36 and the flame detector 34 for connecting them mutually via a valve body passage 1*a*. Numeral 2 designates a shaft, which is provided movably as described later in an orthogonal direction to the valve body passage 1*a* of the valve body 1. There is fitted to an end of the shaft 2 a valve component 3 having a recess portion 3*a*. The valve component 3 is drawn out of and is pushed into the valve body passage 1*a* so that the valve body passage 1*a* can be opened and closed.

The shaft 2 is in a threaded engagement with a threaded portion 6 of a handle fitting portion 5 so as to be rotatable and a handle 4 is connected to the other end of the shaft 2 so that the handle 4 is fitted to the valve body 1 via the shaft 2 and the handle fitting portion 5. When the handle 4 is rotated, the shaft 2 is rotated around the threaded portion 6 to move in a rightward direction in the figure as it rotates and the valve component 3, fitted to the end of the shaft 2, is drawn out of the valve body passage 1*a*. Thus, the valve body passage 1*a* is opened and the flame detector 34 thereunder is connected to the inner cylinder 32. If the passage 1*a* is to be closed, reverse action thereto is taken.

Figure 2A:
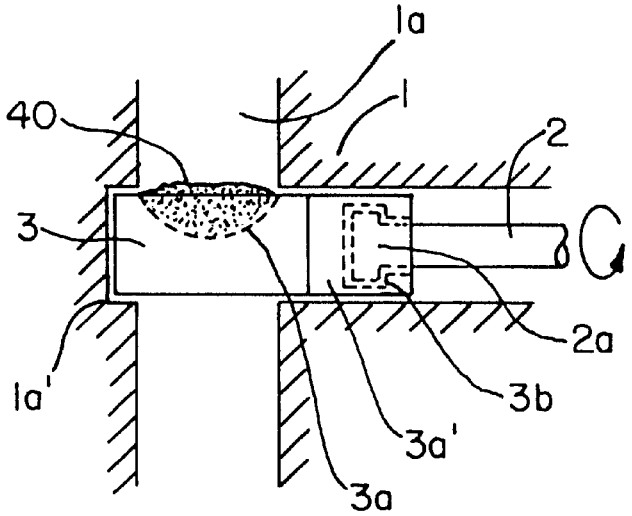
FIGS. 2(*a*)–2(*c*) are views of a fitting state of a valve body of the embodiment of FIG. 1, wherein FIG. 2(*a*) is a cross sectional side view of showing a valve component closing a valve body passage, FIG. 2(*b*) is a plan view thereof and FIG. 2(*c*) shows the valve component being retracted to open the valve body passage.
Figure 2B:
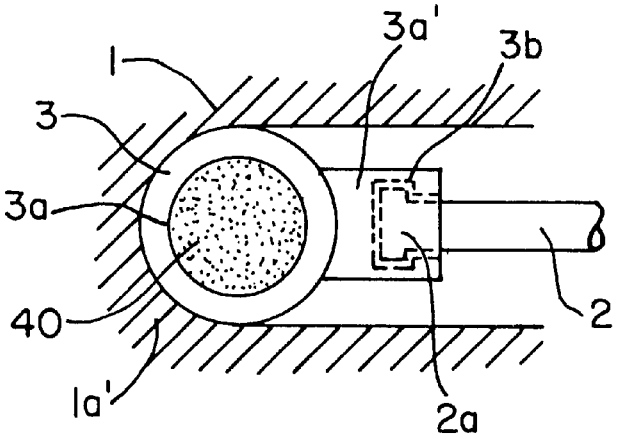
Figure 2C:
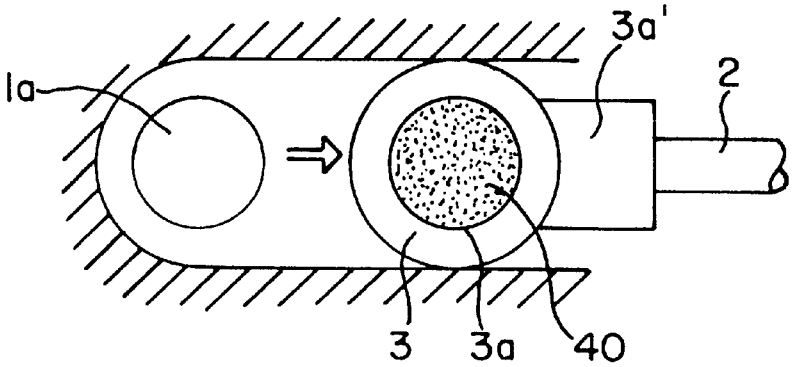

FIGS. 2(*a*) to 2(*c*) are views of a fitting state of the valve body 1 of the embodiment of FIG. 1, wherein FIG. 2(*a*) is a cross sectional side view showing the valve component 3 closing the valve body passage 1*a,* FIG. 2(*b*) is a plan view thereof and FIG. 2(*c*) shows the valve component 3 being retracted to open the valve body passage 1*a.*

In FIGS. 2(*a*) and (*b*), when the valve is closed, ash 40 is collected in the recess portion 3*a* of the valve component 3 and the valve component 3 is inserted into an enlarged portion 1*a'* of the valve body passage 1*a* so that the valve body passage 1*a* is closed completely and no ash 40 comes in thereunder.

There is provided a shaft fitting portion 3*a'* in the valve component 3 and a groove 3*b* is formed in the shaft fitting portion 3*a'*. In the groove 3*b,*a shaft projection portion 2*a* is inserted rotatably. The shaft 2, which is connected to the handle 4 as mentioned above, is rotated as the handle 4 is rotated and the shaft projection portion 2*a* at the end of the shaft 2 engages with the groove 3*b* of the shaft fitting portion 3*a'* so as to be rotatable therein. As the handle 4 is rotated, the shaft 2 is retracted toward the right side in the figure so that the valve component 3 is drawn out of the valve body passage 1*a.*

In FIGS. 2(*a*) and (*b*), when the ash 40 piles up in the recess portion 3*a,* if the valve component 3 is drawn out, there is a fear that the ash 40 so piled in the recess portion 3*a* may be scraped by an edge of the valve body passage 1*a* so as to fall down on a surface of the glass plate. Hence, the ash 40 is blown as described later in FIG. 3, immediately before the valve component 3 is drawn out.

Figure 3:
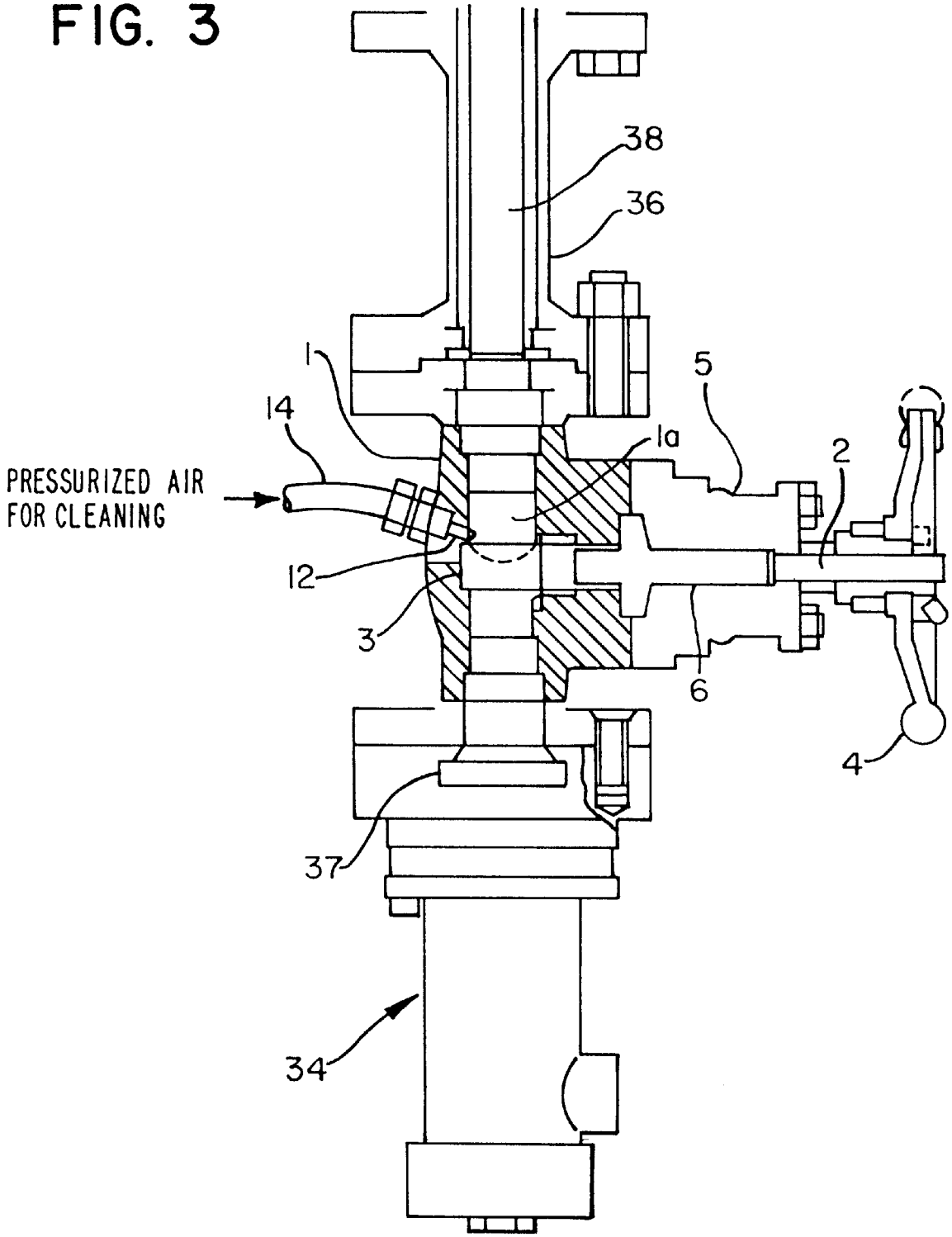
FIG. 3 is a cross sectional view of a cleaning air nozzle applicable to the flame detecting device of the starter combustor of the embodiment of FIG. 1.

FIG. 3 is a cross sectional view of a cleaning air nozzle applicable to the flame detecting device of the starter combustor of the embodiment according to the present invention. In FIG. 3, an air nozzle 12 is inserted from outside into the valve body passage 1*a* above the valve component 3 for supplying therefrom pressurized air for cleaning via an air tube 14 connected to the air nozzle 12, so that the ash 40 piled in the recess portion 3*a* is blown immediately before the valve component 3 is drawn out. The ash 40 so blown goes up in the pipe 38 and flows out of an opening at the end portion 38*a* where it is mixed into the combustion gas coming from the pressurized fluidized bed boiler 13.

The blowing of the cleaning air is done such that, immediately before the valve component 3 is moved for opening the valve body passage 1*a* when the starter combustor 30 is to be driven, a valve (not shown) provided on the way of the air tube 14 is opened and the air is injected from the air nozzle 12 toward the recess portion 3*a* for blowing the ash 40.

FIG. 2(*c*) shows the valve component 3 being drawn out of the valve body passage 1*a* so that the valve body passage 1*a* is opened. The valve component 3 can be drawn outside of the valve body passage 1*a* without the ash falling down on the glass plate 37 of the flame detector 34 as there remains no ash 40 in the recess portion 3*a* as it has been blown off or even if some ash still in the recess portion 3*a*.

In the flame detecting device of the embodiment constructed as mentioned above, the starter combustor 30 is started at the time of plant start for driving of the gas turbine 11 and in this case, it is necessary to watch the flame state in the combuster. Hence the handle 4 is rotated to effect movement of the shaft 2 and the valve component 3 is drawn out of the valve body passage 1*a* so that the valve body passage 1*a* is opened. At this time, the ash 40 which had been collected in the recess portion 3*a* is blown off immediately before the valve component 3 is drawn out and then the valve component 3 is taken out of the valve body passage 1*a.* In this circumstance, the flame state in the combustor at the starting time can be confirmed.

In the ordinary operation of the plant, the starter combustor is stopped and at this time, the high temperature combustion gas coming from the pressurized fluidized bed boiler 13 is supplied into the gas turbine 11 via the interior of the starter combustor 30. In this state, the handle 4 is rotated reversely in advance so that the shaft 2 is moved toward the direction of the valve body 1 and the valve component 3 is inserted in the valve body passage 1*a,* and the valve body passage 1*a* is closed completely as shown in FIG. 2(*a*).

As mentioned above, while the valve body passage 1*a* is closed by the valve component 3, the gas turbine 11 is operated ordinarily by the high temperature combustion gas of the pressurized fluidized bed boiler 13. At this time, the ash 40 contained in the combustion gas comes in from the end portion 38*a,* which is open as shown in FIG. 1, and falls down in the pipe 38. However, as the inlet of the flame detector 34 is closed by the valve component 3, and thus the ash is collected in the recess portion 3*a* of the valve component 3 as shown in FIG. 2(*a*) so as not to fall down further and the glass plate 37 is not dirtied. Hence, there is no fear of non-functioning of the flame detector 34 due to the ash 40 being accumulated on the surface of the glass plate 37.

Figure 4:
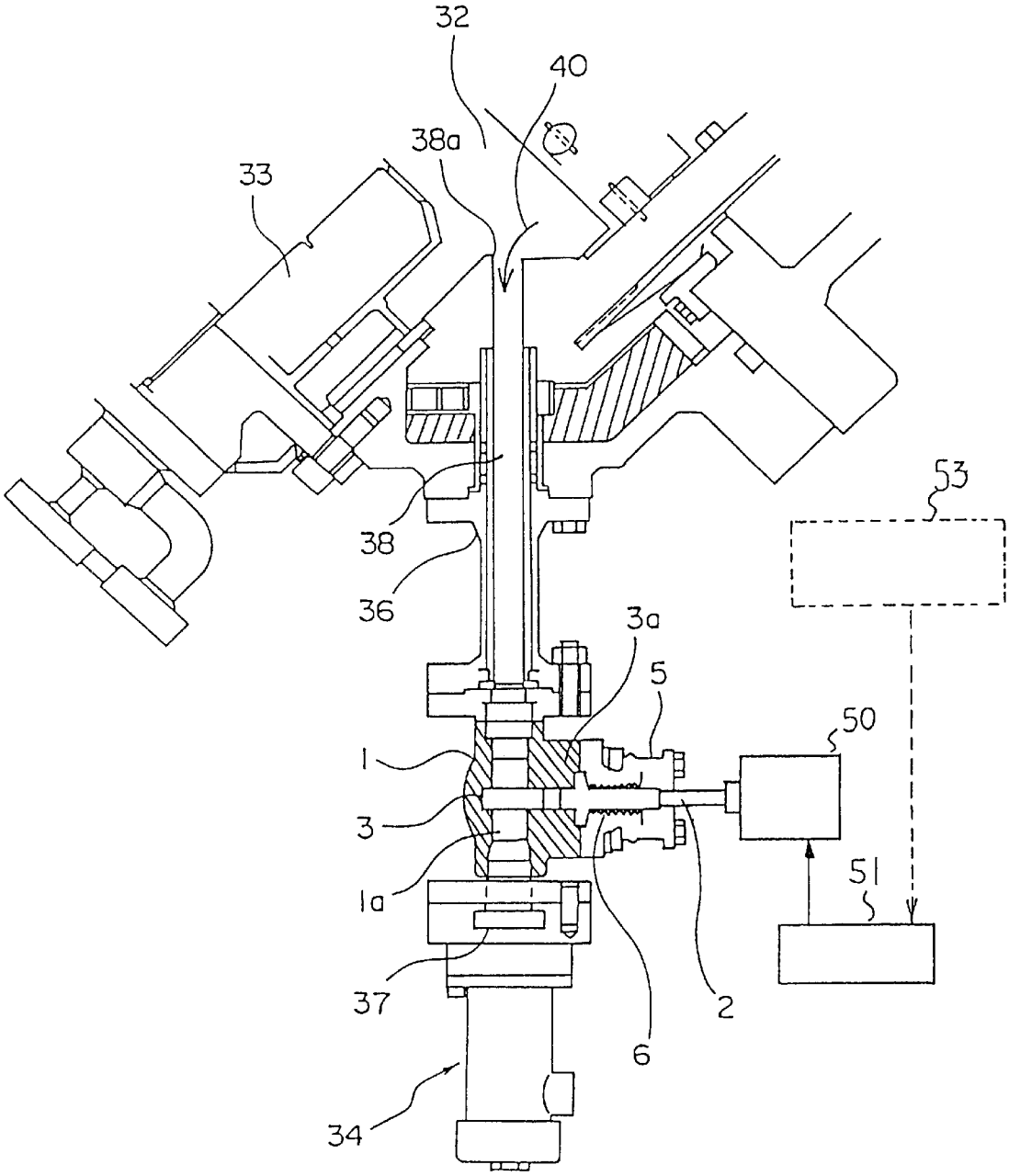
FIG. 4 is a cross sectional view of a flame detecting device for a combustor according to a second embodiment of the present invention.
Figure 5:
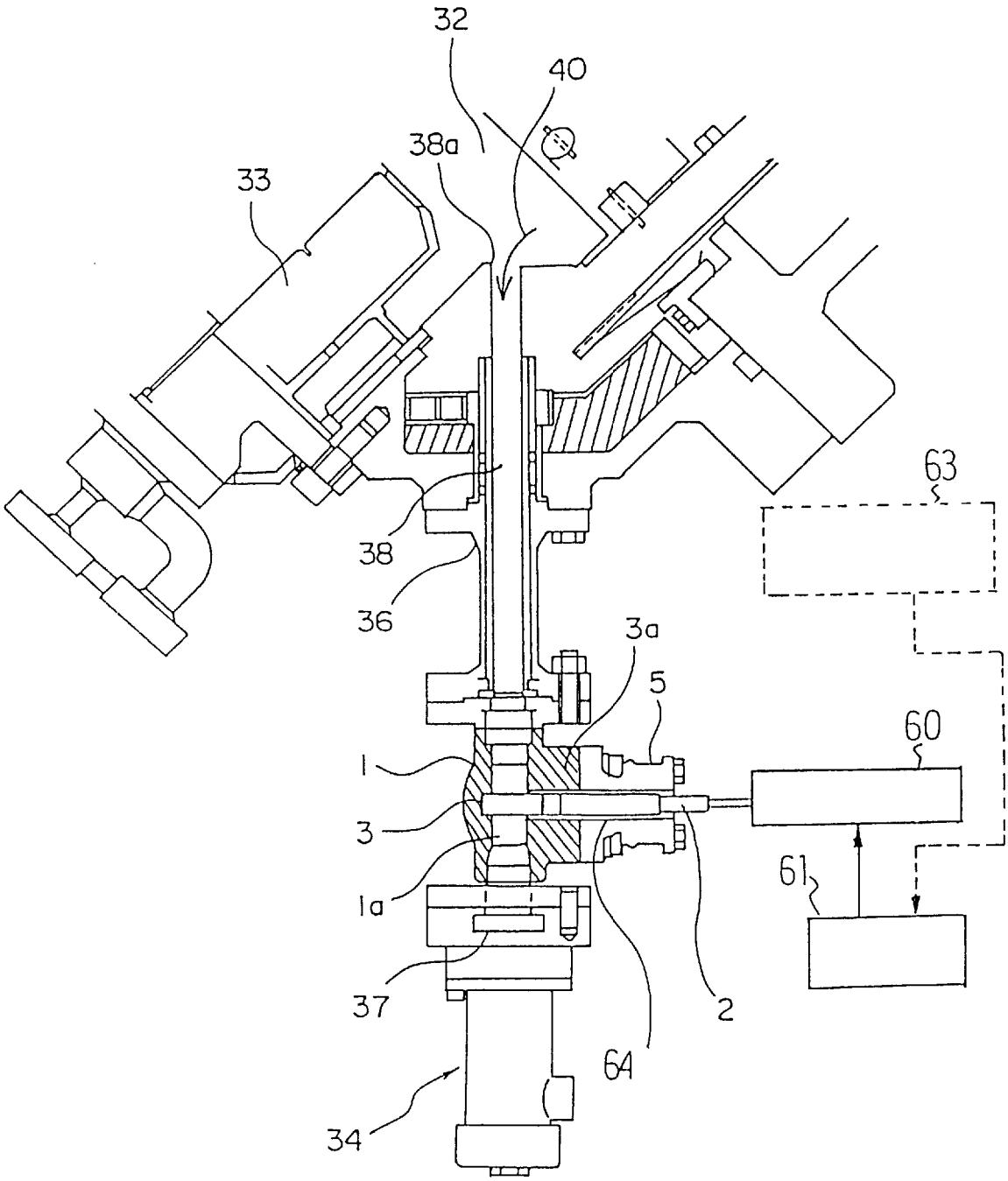
FIG. 5 is a cross sectional view of a flame detecting device for a combustor according to a third embodiment of the present invention.
Figure 6:
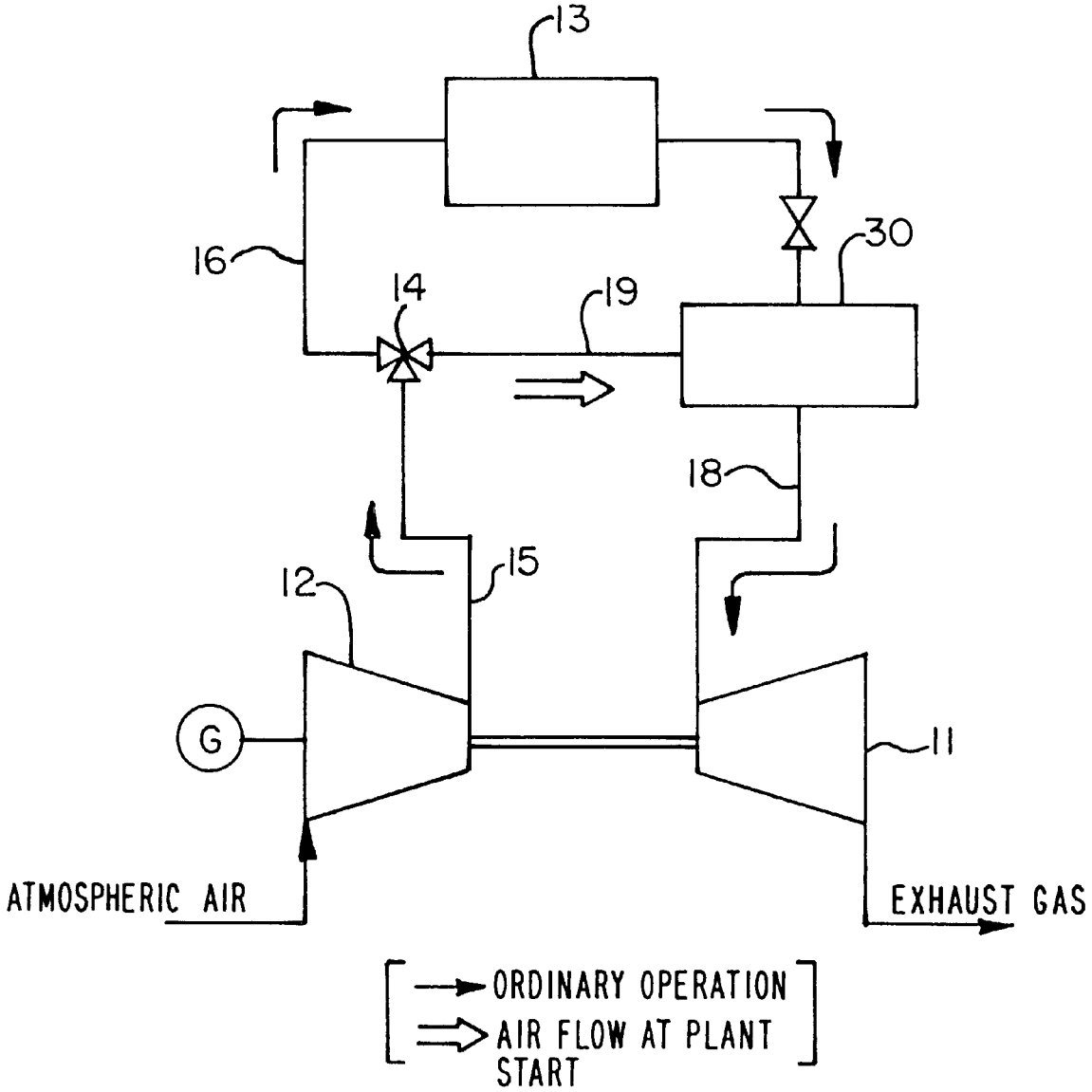
FIG. 6 PRIOR ART
FIG. 6 is a schematic view of a prior art pressurized fluidized bed combined cycle power system.

It is to be noted that the handle 4 may be rotated manually for movement of the valve component 3 or an automatic system for movement of the valve component 3 may be employed. If an automatic system is to be employed, as shown in FIG. 4, a control unit 51 is associated, for example, with a burner igniting signal 53 of the starter combustor so that the handle 4 is rotated by a motor etc. concurrently with starting of the starter combustor. Alternatively, as shown in FIG. 5, in the place of the threaded portion 6, the shaft 2 can be slidable, in the handle fitting portion 5 so as to be movable by an actuator 60 that is energized in response to a burner ignition signal 63 received by control unit 61 so that the valve component 3 may be moved.

According to the embodiment as described above, while the starter combustor is not in use, the valve body passage 1*a* is closed by the valve component 3, thereby the ash coming through the pipe 38 in the ordinary operation time is collected in the recess portion 3*a* of the valve component 3 so as not to fall down further. When the starter combustor is to be operated, the ash collected in the recess portion 3*a* is blown off by the air and then the valve component 3 is moved outside of the valve body passage 1*a* so that the valve body passage 1*a* is opened and the flames are detected by the flame detector 34.

Further, if a large amount of ash is collected in the recess portion 3*a* of the valve component 3, air is injected for dispersing the ash into the combustor, thereby there occurs no accumulation of the ash on the surface of the glass plate 37 of the flame detector 34. Thus, disorder of the flame detector due to accumulation of the coal ash can be effectively prevented.

It is to be noted that although an example of the flame detector used in the starter combustor of the pressurized fluidized bed combined cycle power system has been described in the above embodiment, the present invention is not limited thereto but may be applied also to a flame detector of a coal gasifying combined cycle power system which comprises a similar combustor and a similar effect can be obtained in this case also.

What is claimed is:

1. A combustor flame detecting device for use in a gas turbine starter combustor in a pressurized fluidized bed combined cycle power system in which a gas turbine is driven by a combustion gas from a pressurized fluidized bed boiler, said combustor flame detecting device comprising a flame detector connected to a passage connecting to an interior of the starter combustor; a valve component provided in said passage at an inlet portion of said flame detector and having a recess portion for receiving ash coming into said flame detector from the interior of the starter combustor; and a driving device connected to said valve component for opening and closing said passage.

2. A combustor flame detecting device for use in a gas turbine starter combustor in a pressurized fluidized bed combined cycle power system in which a gas turbine is driven by a combustion gas from a pressurized fluidized bed boiler, said combustor flame detecting device comprising a flame detector connected to a passage connecting to an interior of the starter combustor; a valve component provided in said passage at an inlet portion of said flame detector and having a recess portion for receiving ash coming into said flame detector from the interior of the starter combustor; a drive device connected to said valve component for opening and closing said passage; and an air nozzle system communicating with said passage from outside of said passage for blowing pressurized cleaning air to the vicinity of the recess portion of said valve component.

3. A combustor flame detecting device as claimed in claim 1, wherein said drive device comprises a shaft which is connected rotatably to said valve component and is movable in a direction orthogonal to said passage by being rotated while in a threaded engagement with a threaded portion provided in a valve body; and a manual handle connected to said shaft.

4. A combustor flame detecting device as claimed in claim 1, wherein said drive device comprises a shaft which is connected rotatably to said valve component and is movable in a direction orthogonal to said passage by being rotated while in a threaded engagement with a threaded portion provided in a valve body; a motor connected to said shaft; and a controller for controlling said motors, wherein said controller is associated with a burner igniting signal of the starter combustor to rotate said shaft for movement of said valve component.

5. A combustor flame detecting device as claimed in claim 1, wherein said drive device comprises a shaft which is slidably connected to said valve component and is movable in a direction orthogonal to said passage; an actuator connected to said shaft; and a controller for controlling said actuators, wherein said controller is associated with a burner igniting signal of said starter combustor for movement of said valve component.

6. A combustor flame detecting device as claimed in claim 5, wherein said drive device comprises a shaft which is connected rotatably to said valve component and is movable in a direction orthogonal to said passage by being rotated while in a threaded engagement with a threaded portion provided in a valve body; and a manual handle connected to said shaft.

7. A combustor flame detecting device as claimed in claim 5, wherein said drive device comprises a shaft which is connected rotatably to said valve component and is movable in a direction orthogonal to said passage by being rotated while in a threaded engagement with a threaded portion provided in a valve body; a motor connected to said shaft; and a controller for controlling said motor, wherein said controller is associated with a burner igniting signal of the starter combustor to rotate said shaft for movement of said valve component.

8. A combustor flame detecting device as claimed in claim 5, wherein said drive device comprises a shaft which is slidably connected to said valve component and is movable in a direction orthogonal to said passage; an actuator connected to said shaft; and a controller for controlling said actuators, wherein said controller is associated with a burner igniting signal of said starter combustor for movement of said valve component.

* * * * *